US008465116B2

(12) United States Patent
Mori et al.

(10) Patent No.: US 8,465,116 B2
(45) Date of Patent: Jun. 18, 2013

(54) PRINTING APPARATUS AND PRINTING METHOD

(75) Inventors: Tatsuya Mori, Kawasaki (JP); Kiyomi Aono, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 12/851,853

(22) Filed: Aug. 6, 2010

(65) Prior Publication Data

US 2011/0050773 A1 Mar. 3, 2011

(30) Foreign Application Priority Data

Aug. 28, 2009 (JP) ..... 2009-198054

(51) Int. Cl.
*B41J 29/38* (2006.01)
*B41J 2/165* (2006.01)

(52) U.S. Cl.
USPC ..... 347/14; 347/9; 347/23; 347/35

(58) Field of Classification Search
USPC ..... 347/14, 23, 9, 19, 35–36
See application file for complete search history.

(56) References Cited

U.S. PATENT DOCUMENTS 6,527,358 B2 3/2003 Kuriyama et al.
2007/0229578 A1 10/2007 Yokozawa et al.
2010/0321431 A1* 12/2010 Mori ..... 347/9

FOREIGN PATENT DOCUMENTS

JP 3382526 B2 12/2002
JP 2007-290352 A 11/2007

* cited by examiner

*Primary Examiner* — Jason Uhlenhake
(74) *Attorney, Agent, or Firm* — Fitzpatrick, Cella, Harper & Scinto

(57) ABSTRACT

In a printing apparatus and a printing method, the frequency of an operation of detecting an inappropriate ejection state of each ejection port is increased, while allowing a decrease in throughput to be suppressed. The printing apparatus includes a first ejection state sensing unit for carrying out an ejection state sensing process in which determination of whether or not ejected droplets are normal is executed, during a single process, on all the ejection ports formed in the print head. The printing apparatus further includes a second ejection state sensing unit for carrying out the ejection state sensing process on the ejection ports in a part of a plurality of ejection port groups into which the plurality of ejection ports formed in the print head are divided.

5 Claims, 12 Drawing Sheets

PRINTING APPARATUS AND PRINTING METHOD

BACKGROUND OF THE INVENTION

1. Field of the Invention

The present invention relates to a printing apparatus and a printing method in which a print medium is printed by allowing a print head to eject droplets onto the print medium, and in particular, to a printing apparatus and a printing method in which the status of ejection of droplets through ejection ports is sensed.

2. Description of the Related Art

In recent years, ink jet printing apparatuses have been prevailing rapidly in which print media are printed by allowing a print head to eject ink droplets. Many ink jet printing apparatus adopt an ink droplet ejection method in which ink is heated to cause film boiling so that the resulting pressure allows ink droplets to fly. Unlike an electrophotographic scheme, this method requires no intermediate transfer unit and thus needs few intervening elements in forming images. Hence, the method has the advantage of allowing intended images to be stably obtained.

However, in the ink jet printing apparatus, inappropriate ink ejections may result from, for example, blockage of ejection ports by dust or thickened ink, disconnection of wire extending to a heater for the purpose of heating ink, coverage of ejection ports with ink droplets. Such an inappropriate ink ejection may be an ejection failure state in which no ink droplets are ejected through ejection ports, a state in which ink droplets are ejected but in which an ejection amount is smaller than a predetermined value, or deviation of impact positions of ejected ink droplets. When ink is inappropriately ejected, ink droplets may impact the print medium at positions deviating from the desired ones or fail to impact the print medium. This may lead to white or black stripes on print images.

A technique using a light emission element and a light reception element is known as means for sensing the occurrence of inappropriate ink ejection through such ejection ports. In a method for sensing the inappropriate ink ejection state by the sensing means that uses the light emission element and the light reception element, the light emission element and the light reception element are positioned such that ink droplets pass between the elements. Thus, when ink is ejected, a change in the quantity of light passing between the elements is sensed. In this manner, the occurrence of the inappropriate ejection state is sensed by determining whether or not light emitted by the light emission element is blocked by ink droplets.

If the inappropriate ejection state is sensed in the ink jet printing apparatus with the sensing means described above, what is called inappropriate-ejection compensation printing can be performed in which a dot supposed to be formed by an ejection port in the inappropriate ejection state is compensatorily formed by a different ejection port. Thus, even if any ejection port is determined to be in the inappropriate ejection state, the ejection through the ejection port is compensated for to allow formation of high-quality images to be maintained.

The inappropriate ejection state of each ejection port can be found earlier by increasing the frequency of the operation of sensing the inappropriate ejection state. Then, ejection ports in the inappropriate ejection state can be immediately compensated for. Thus, in the conventional printing apparatuses, safety ratio is set to be high, and the frequency of the operation of detecting the inappropriate ejection tends to be set to a relatively large value.

However, in general, the printing operation is suspended while the operation of detecting the inappropriate ejection state of each ejection port is being performed. Thus, when the sensing operation is frequently performed, the time for which printing is suspended increases. If the frequency of the operation of sensing the inappropriate ejection state is high excessively, the time for which printing is suspended increases more than necessary. This may reduce printing throughput.

The recent tendency is such that the length of the print head is increased, with ejection ports densely arranged therein. This tends to further increase the time required for a single operation of detecting inappropriate ejection. Furthermore, the recent year, the application of the printing apparatus has expanded even to large-sized print media for industrial or business use by using of the longer print head. There has been a demand for a further increase in print speed and further improvement of image quality even for printing apparatuses adapted for such large-sized print media. Thus, attempts have been made to further increase the length of the print head (for example, by at least 1 inch) and the integration degree thereof, resulting in an increase in the number of ejection ports in the print head. In such a printing apparatus, when the operation of detecting inappropriate ejection is performed on all the ejection ports during a single process, the operation of detecting the inappropriate ejection state of each ejection port requires much more time.

In contrast, Japanese Patent Laid-Open No. 2007-290352 discloses a printing apparatus configured to perform the operation of detecting ejection ports in the inappropriate ejection state at a frequency corresponding to the accumulated number of ejections in order to suppress a decrease in the throughput of the printing operation associated with the operation of detecting ejection ports in the inappropriate ejection state. This prevents the operation of detecting ejection ports in the inappropriate ejection state from being unnecessarily frequently performed. As a result, a decrease in print throughput can be suppressed. However, the printing is also suspended when the operation of detecting the inappropriate ejection state of each ejection port is performed in the printing apparatus according to Japanese Patent Laid-Open No. 2007-290352. Thus, performing the operation of detecting the inappropriate ejection state of each ejection port increases the time required for printing, resulting in a decrease in printing throughput.

Furthermore, Japanese Patent No. 3382526 discloses a printing apparatus configured to perform printing with the print head carrying out reciprocating scans, wherein during the forward scan, both the printing operation and the operation of detecting the inappropriate ejection state are executed. In this printing apparatus, ejection ports determined to be in the inappropriate ejection state are subjected to compensatory printing during the backward scan. This allows prevention of printing with droplets through which any ejection ports in the inappropriate ejection state in the print head. Thus, degradation of the quality of images obtained by printing can be prevented. However, in the printing apparatus according to Japanese Patent No. 3382526, even when printing is to be performed both during the forward scan and the backward scan, one of the scans needs to be assigned to the operation of detecting the inappropriate ejection state without performing printing. Hence, if printing is performed by a printing apparatus in which the printing is suspended during the operation of detecting the inappropriate ejection state, then during one of the forward and backward scans, the printing is suspended while the inappropriate ejection state detection operation is being performed. This increases the time required for printing, thus reducing throughput.

It is thus difficult to meet both of the conflicting requirements, that is, suppression of a decrease in throughput and improvement of image quality.

SUMMARY OF THE INVENTION

Thus, in view of the above-described circumstances, an object of the present invention is to provide a printing apparatus and a printing method in which the frequency of the operation of detecting the inappropriate ejection state of each ejection port is increased to prevent degradation of quality of print images and improve reliability, while allowing a decrease in throughput to be suppressed.

According to a first aspect of the present invention, there is provided a printing apparatus in which a print head including a plurality of ejection ports formed therein is capable of being mounted, a liquid being ejected through the ejection ports, the printing apparatus comprising: first ejection state sensing means for carrying out a first ejection state sensing process in which an ejection state sensing process of determining whether or not ejected droplets are normal is executed, during a single process, on all the ejection ports formed in the print head; and second ejection state sensing means for carrying out a second ejection state sensing process in which the ejection state sensing process is executed on the ejection ports in apart of a plurality of ejection port groups into which the plurality of ejection ports formed in the print head are divided, wherein the second ejection state sensing process is carried out between end of printing of one print medium and start of printing of a next print medium.

According to a second aspect of the present invention, there is provided a printing method of performing printing using a printing apparatus in which a print head including a plurality of ejection ports formed therein is capable of being mounted, a liquid being ejected through the ejection ports, the printing method comprising: a first ejection state sensing process step of carrying out an ejection state sensing process of determining whether or not ejected droplets are normal, during a single process, on all the ejection ports formed in the print head; and a second ejection state sensing process step of carrying out the ejection state sensing process on the ejection ports in a part of a plurality of ejection port groups into which the plurality of ejection ports formed in the print head are divided, the ejection state sensing process being carried out between end of printing of one print medium and start of printing of a next print medium.

According to the present invention, the frequency of the operation of detecting the inappropriate ejection state of each ejection port is increased to allow prevention of printing with certain ejection ports in the inappropriate ejection state. This enables degradation of quality of print images to be prevented, while allowing the reliability of the printing apparatus to be improved. At the same time, a decrease in throughput can be suppressed, thus enabling wait time to be reduced to prevent the user from feeling burdensome.

Further features of the present invention will become apparent from the following description of exemplary embodiments (with reference to the attached drawings).

DESCRIPTION OF THE EMBODIMENTS

An embodiment for carrying out the present invention will be described below with reference to the attached drawings.

An ink jet printing apparatus according to the embodiment of the present invention will be described. Here, an ink jet printing apparatus 200 configured to print roll paper will be described.

Figure 1:
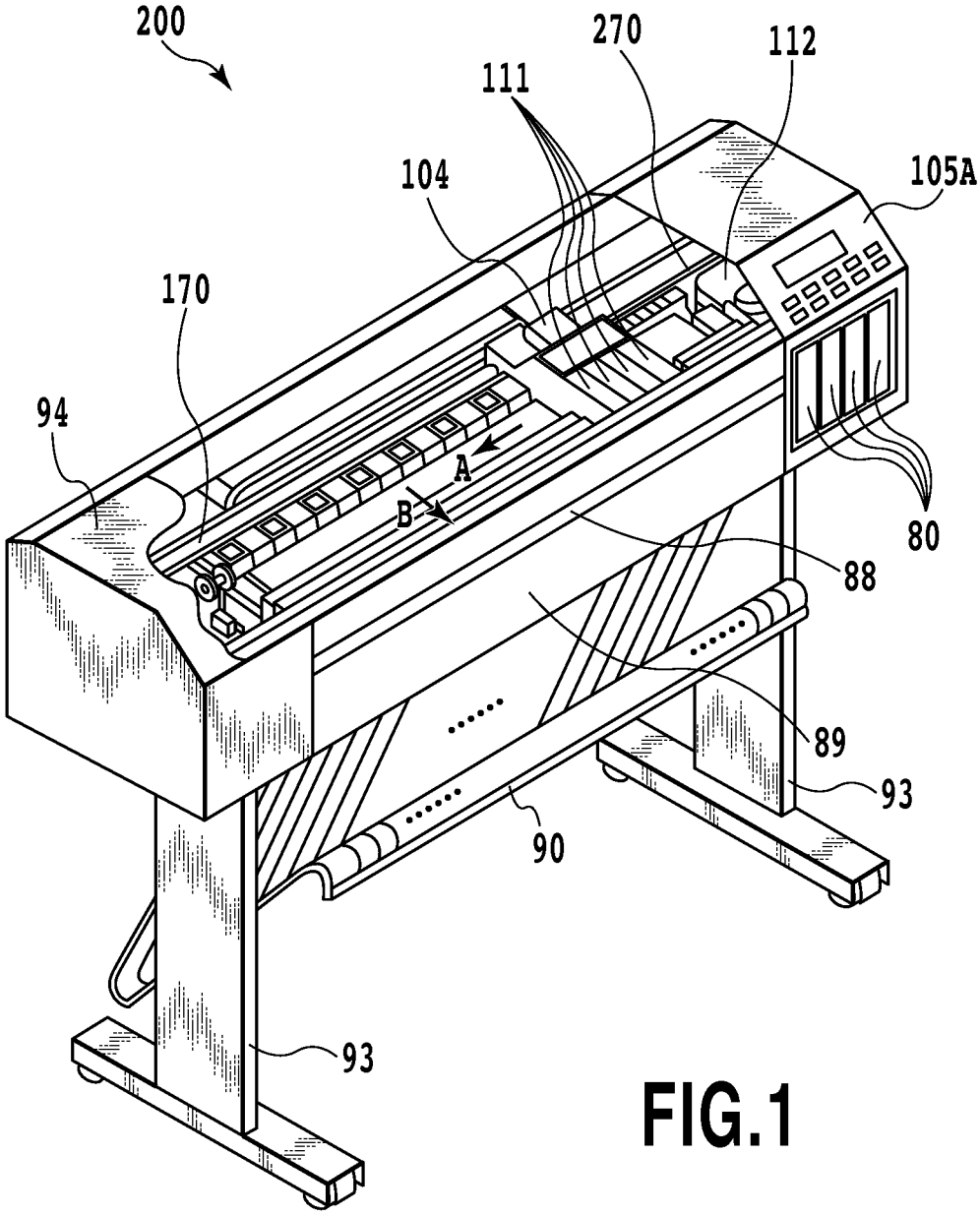
FIG. 1 is a perspective view showing the appearance of a printing apparatus according to an embodiment of the present invention.

FIG. 1 is a perspective view of an ink jet printing apparatus 200 (hereinafter also simply referred to as a printing apparatus) which is partly exploded so as to show the internal structure. FIG. 1 shows the ink jet printing apparatus 200 with an upper cover removed therefrom.

As shown in FIG. 1, a manual insertion port 88 is formed in the front surface of the printing apparatus 200. A roll paper cassette 89 that can be opened forward is provided under the manual insertion port 88 in FIG. 1. Cut paper with a fixed length can be inserted through the manual insertion port 88. Print media such as print paper are fed into the printing apparatus through the manual insertion port 88 or the roll paper cassette 89. The printing apparatus 200 includes an apparatus main body 94 supported by two leg portions 93 and a stacker 90 on which discharged print media are loaded. Furthermore, an operation panel 105A, an ejection state sensing unit 112, and an ink tank 80 are disposed on the right of an apparatus main body 94 in FIG. 1.

As shown in FIG. 1, the printing apparatus 200 includes a conveying roller 170 configured to convey print media such as print paper in the direction of an arrow B (sub-scanning direction). Moreover, the printing apparatus 200 includes a carriage unit (hereinafter referred to as a carriage) 104 supported and guided so as to be reciprocatable in the width direction of a print medium (in the direction of arrow A; a main scanning direction). Furthermore, the printing apparatus includes a carriage motor (not shown in the drawings) and a carriage belt (hereinafter referred to as a belt) 270 configured so as to reciprocate the carriage 104 in the direction of arrow A. In the printing apparatus 200 according to the present embodiment, an ink jet print head (hereinafter referred to as a print head) 111 can be mounted in the carriage 104. That is, the print head 111 carries out printing by ejecting droplets through ejection ports while scanning a print medium in the direction crossing the direction in which the print medium is conveyed. Furthermore, a photosensor unit configured to sense a paper position is installed in the carriage 104. The printing apparatus further includes an ink tank 80 from which ink is fed to the print head 111 and the ejection state sensing unit 112 described below and configured to sense the inappropriate ejection state of the print head 111.

Figure 2:
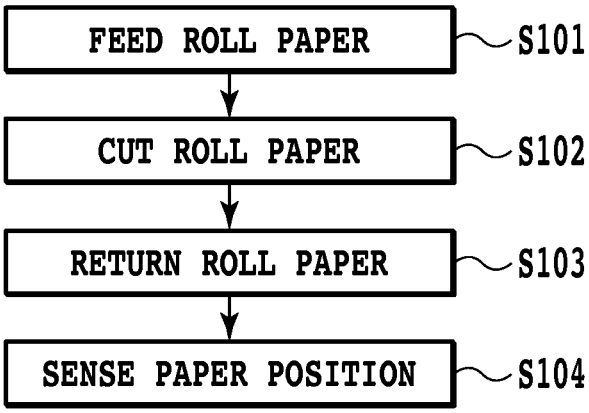
FIG. 2 is a flowchart showing a process from the end of printing of one page until the placement of the next print medium at a print position which process is executed when the printing apparatus in FIG. 1 is used to perform continuous printing.

If the roll paper cassette 89 is used to continuously print roll paper, such a process as shown in FIG. 2 is executed between the end of printing of one page and the start of printing of the next page. FIG. 2 is a flowchart showing a process from the end of printing of one page until the placement of the next print medium at a print position. In the present embodiment, a roll paper feeding process S101, a roll paper cutting process S102, a roll paper returning process S103, a paper position sensing process S104, and the like are carried out between printing of one page and printing of the next page. In the roll paper feeding process S101, to be cut at the end of the page, roll paper is fed such that the end of the roll paper is positioned at a cut position corresponding to a cutter. Furthermore, in the roll paper return process S103, the roll paper is returned such that before printing of the next page is started, the end of the roll paper has been placed at a print position for the next page. In the paper position sensing process S104, the photosensor unit is used to sense the paper position to determine whether or not the paper is misaligned.

Figure 3:
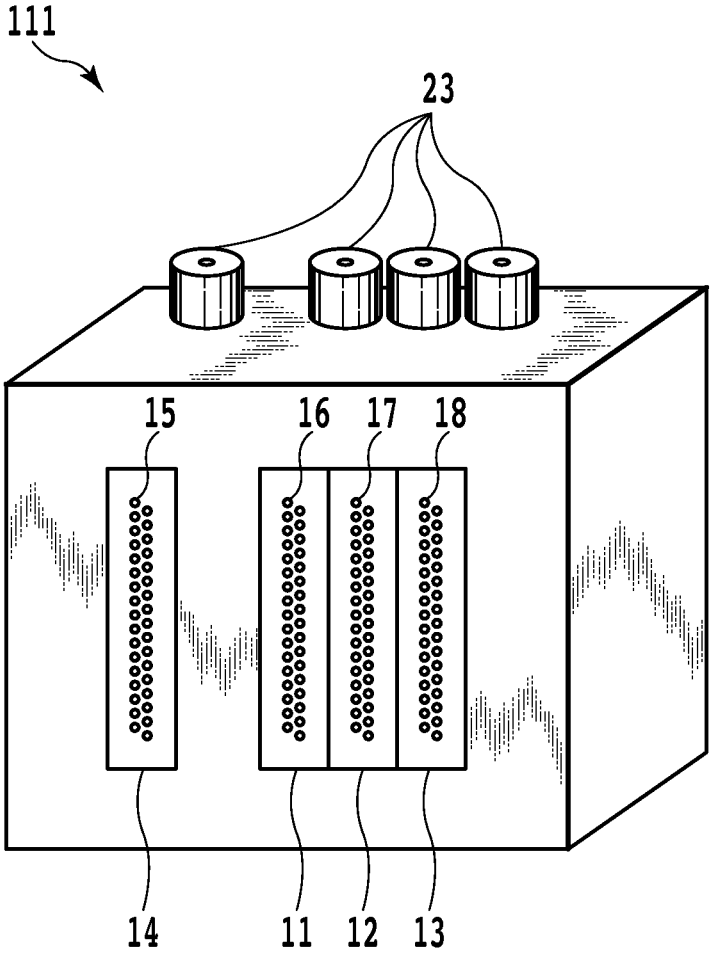
FIG. 3 is an enlarged perspective view showing a print head mounted in the printing apparatus in FIG. 1.

FIG. 3 is a perspective view of the appearance of the print head 111 mounted in the carriage 104. As shown in FIG. 3, the print head 111 includes a black print head 14 configured to eject black ink and including a plurality of ejection ports 15 arranged therein and through which black ink is ejected. The print head 111 also includes a cyan head 11, a magenta head 12, and a yellow head 13 configured to eject cyan ink, magenta ink, and yellow ink, respectively, and including ejection ports 16, 17, and 18 arranged therein and through which cyan ink, magenta ink, and yellow ink, respectively, are ejected.

Figure 4:
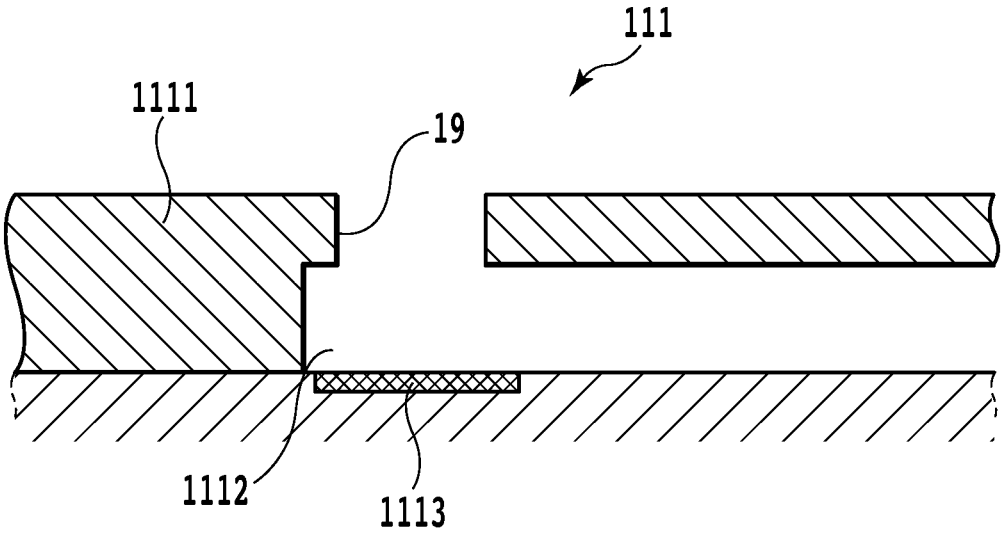
FIG. 4 is an enlarged sectional view showing the periphery of the ejection port in the print head in FIG. 3.

FIG. 4 is a sectional view of the periphery of an ejection port in the print head 111. As shown in FIG. 4, a rectangular heater 1113 serving as an electrothermal transducing element is provided at a predetermined position on an element substrate 1115. An orifice plate 1111 is disposed on the heater 1113. The orifice plate 1111 includes the ejection port 19 that is open at a position corresponding to a central portion of the heater 1113. The print head 111 allows the heater 1113 serving as an electrothermal transducing element to convert electric energy into heat energy so that the heat energy allows bubbles to be generated in the ink in a bubbling chamber 1112. The resulting bubbling pressure allows ink droplets to be ejected through the ejection port 19.

The printing apparatus 200 according to the present embodiment includes the ejection state sensing unit 112 configured to sense that any ejection port in the print head 111 is in the inappropriate ejection state.

Figure 5:
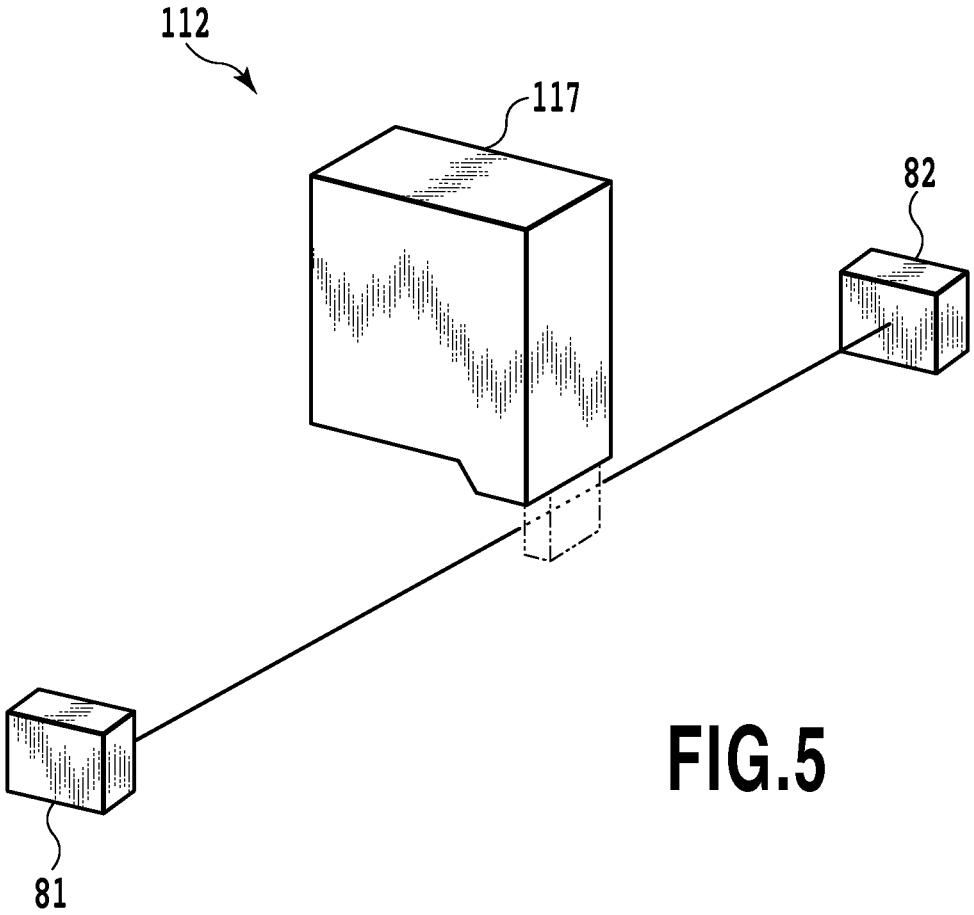
FIG. 5 is schematic perspective view showing an ejection state sensing unit used while an ejection state sensing process is performed by the printing apparatus in FIG. 1.

The configuration of an ejection state sensing unit 112 configured to carry out an ejection state sensing process will be described. FIG. 5 shows the arrangement of the ejection state sensing unit 112 and the print head 111. The ejection state sensing unit 112 includes a light emission element 81 and a light reception element 82. The light emission element 81 and the light reception element 82 are arranged such that light emitted by the light emission element 81 crosses the trajectory of ink droplets ejected through a sensed ejection port in a state different from the inappropriate ejection state, and then reaches the light reception element 82. When ink droplets are ejected from the print head 111 straight toward the desired impact position in a state different from the inappropriate ejection state, light from the light emission element 81 is blocked by the ink droplets to reduce the quantity of light reaching the light reception element 82. The ejection state sensing unit 112 for ink droplets detects the decrease in light quantity to sense whether the ejection port in the inappropriate ejection state is present or not. A voltage corresponding to the detected light quantity (ink ejection amount) can be obtained from the light reception element 82. The voltage is thus compared with a predetermined voltage value Vref using a comparator 83, to sense whether the ejected ink is in the inappropriate ejection state or not (photo interrupter scheme). When an amount of ink droplets ejected are excessively small, a small quantity of light is blocked, making the sensing difficult. Furthermore, it is empirically known that in the ejection state sensing process, the inappropriate ejection state can be sufficiently sensed by carrying out eight ejections through each ejection port. Additionally, the amount of time corresponding to 40 ejections per ejection port is required for the comparison using the comparator 83.

When the ejection state sensing unit 112 configured as described above carries out the ejection state sensing process, the ejection state sensing process for the plurality of ejection ports 19 present on an optical axis can be accomplished through one alignment operation. Thus, in a print head in which ejection ports are arranged in a plurality of rows, if the positional relationship is adjusted such that the each ejection port row is placed on the optical axis, the sensing process can be carried out on all the ejection ports by moving the print head a number of times corresponding to the number of rows.

As described above, the printing apparatus according to the present embodiment includes the ejection state sensing unit. Thus, when any ejection port in the print head becomes in the inappropriate ejection state, the ejection state sensing unit can sense the ejection port in the inappropriate ejection state.

Now, the ejection state sensing operation performed by the ejection state sensing unit 112 will be described. The inappropriate ejection state refers to a state which may occur during printing for any reason and in which droplets ejected through the ejection ports fail to impact the respective desired positions. The inappropriate ejection state includes, for example, misalignment of the impact position caused by ejection failure, an insufficient ejection speed, or the like, and ink ejection failure resulting from insufficient refill amount inside the print head. There are two major causes for the occurrence of the inappropriate ejection state at ejection ports. One is the inappropriate condition of the liquid in the bubbling chamber. The other is a failure in any print element. The former inappropriate ejection state caused by the inappropriate liquid condition is often temporary, and in this case, the printing apparatus can often be recovered from the inappropriate ejection state by carrying out a recovery process such as suction recovery. Furthermore, if the latter inappropriate ejection state results from a failure in the print element, recovering the ejection port corresponding to the print element is often impossible.

In an ink jet printing apparatus that uses an ink jet print head ejecting ink by using electrothermal transducing elements as print elements, the inappropriate ejection state is likely to occur when the print head is exposed to a high-temperature environment and when an ink supply frequency can't keep up with an ejection frequency.

To prevent such an inappropriate ejection state, certain measures are usually pre-taken for the print head. However, in a print head that is long in the direction in which the ejection port row extends, the environment including the amount of ink supplied and the temperature and the like is likely to vary. Furthermore, such a variation in environment occurs significantly. This tendency causes the inappropriate ejection state to occur frequently in long print heads.

Moreover, when ejection through an ejection port in the inappropriate ejection state is continued with no measures taken to recover the ejection port to the normal state, heating elements exposed to the air inside the print head may continue to generate heat. If this state lasts long, the durability of the heating elements may be impaired.

However, in the printing apparatus 200 according to the present embodiment, the ejection state sensing unit 112 carries out the process of sensing the ejection state of each ejection port. Thus, if any ejection port becomes in the inappropriate ejection state, the process of sensing the ejection state enables the ejection port in the inappropriate ejection state to be sensed and dealt with. Specifically, inappropriate ejection compensation printing can be performed in which instead of an ejection port in the inappropriate ejection state, an ejection port that is not in the inappropriate ejection state is used for printing. Furthermore, the use, for printing, of the ejection port in the inappropriate ejection state is stopped until the next recovery process is carried out. Thus, the corresponding print element can be prevented from generating unwanted heat. This allows improvement of the reliability of the print elements and thus of the printing apparatus. In this manner, instead of an ejection port in the inappropriate ejection state, another ejection port is used for printing to prevent degradation of the image quality. Additionally, the ejection port in the inappropriate ejection state can be recovered.

In a print head including a large number of ejection ports like a long print head, the recovery process of recovering from the inappropriate ejection state resulting from the inappropriate liquid condition involves a large amount of waste ink used for a single recovery process. Nevertheless, generally, the number of ejection ports determined by a single ejection state sensing process to be in the inappropriate ejection state is small compared to the total number of ejection ports formed in the print head. Thus, if the recovery process is carried out every time the inappropriate ejection state occurs, an excessive amount of waste ink is discharged. This may increase the maintenance cost of the printing apparatus. Hence, the present embodiment uses a printing method (hereinafter referred to as an inappropriate ejection compensation process) in which the recovery process is not carried out every time the inappropriate ejection state is sensed and in which instead of an ejection port determined to be in the inappropriate ejection state, another ejection port is compensatorily used for the corresponding printing. Thus, when any ejection port is determined to be in the inappropriate ejection state, the inappropriate ejection compensation process can be carried out on the ejection port. Therefore, even if any ejection port is in the inappropriate ejection state, printing can be performed without degrading the quality of print images.

Figure 6:
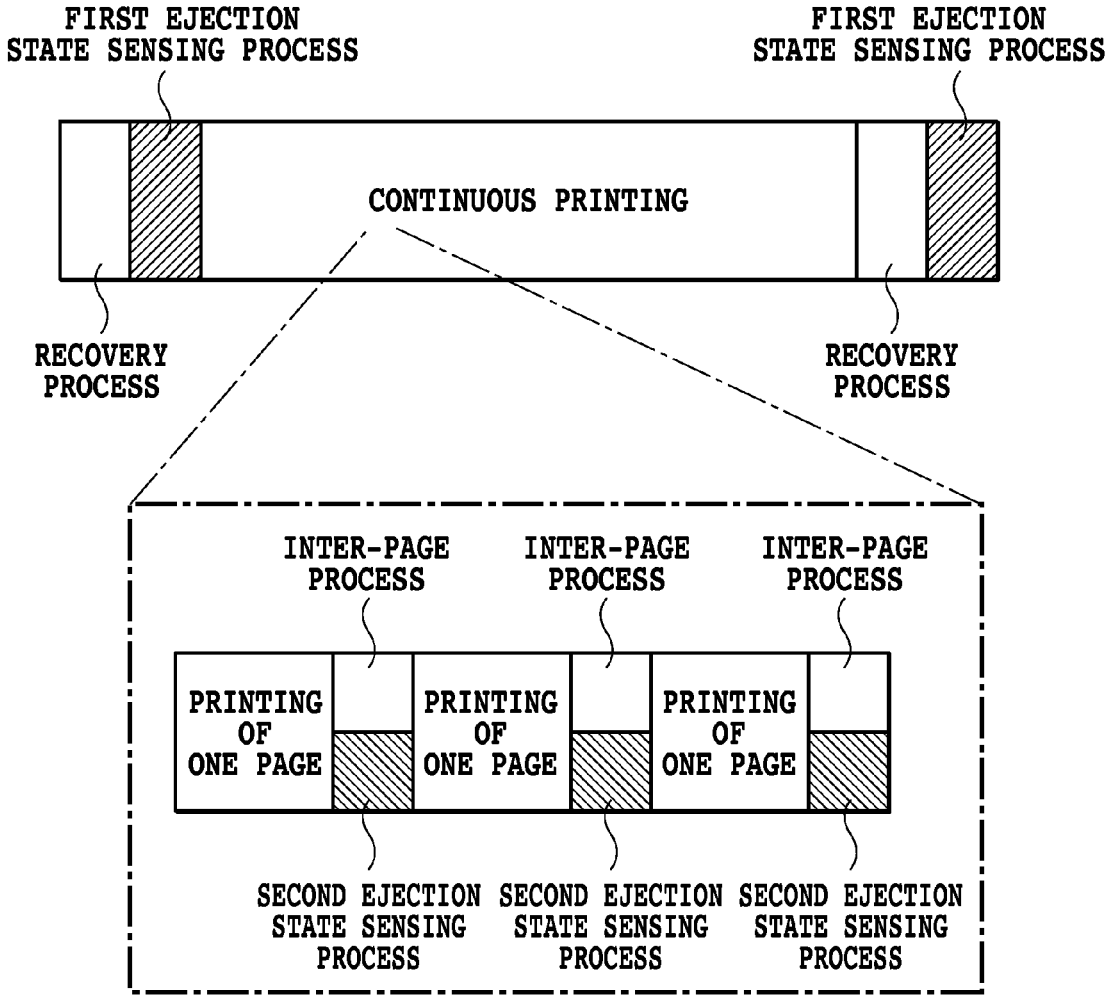
FIG. 6 is a diagram illustrating timings when a first ejection state sensing process and a second ejection state sensing process are performed by the printing apparatus according to the embodiment of the present invention.

The ejection state sensing process in the printing apparatus according to the present embodiment is carried out at such timings as shown in FIG. 6. The ejection state sensing process according to the present embodiment includes a first ejection state sensing process following the recovery process to sense the ejection state of all the ejection ports during a single process, and a second ejection state sensing process carried out divisionally during conveyance of a print medium between each of the first ejection state sensing processes.

The first ejection state sensing process is intended to sense ejection ports recovered from the inappropriate ejection state by the recovery process and become in the ordinary ejection state not in the inappropriate ejection state. The inappropriate ejection state associated with the condition of the stored liquid such as thickening of the liquid is often eliminated by the recovery process. For an ejection port recovered by the recovery process, information indicating that the ejection port is in the inappropriate ejection state is reset. Then, information indicating that the ejection port is not in the inappropriate ejection state is newly stored.

Furthermore, the second ejection state sensing process is intended to sense ejection ports brought into the inappropriate ejection state when the printing operation is performed. The second ejection state sensing process is not carried out on all the ejection ports during a single process but senses the ejection state of all the ejection ports through a plurality of divisional sensing processes.

The first ejection state sensing process may be carried out only on ejection ports determined to be in the inappropriate ejection state before execution of the recovery process in order to reduce the number of ejection ports sensed. Thus, the first ejection state sensing process may be carried out on ejection ports in the inappropriate ejection state.

At least one second ejection state sensing process is carried out on all the ejection ports between the end of the first ejection state sensing process and the start of the next first ejection state sensing process. Here, the second ejection state sensing process is carried out on each of ejection port groups into which the plurality of ejection ports as objects to be sensed are divided. Moreover, the second ejection state sensing process is carried out in parallel with an inter-page process.

Since the second ejection state sensing process is divisionally carried out in parallel with the inter-page process, the ejection state sensing process can be achieved without the need to suspend printing. Thus, the execution of the second ejection state sensing process avoids reducing the throughput.

Thus, the first and second ejection state sensing processes, the two types of ejection state sensing processes intended for the different purposes, are combined together. This enables the frequency of the ejection state sensing process to be increased, with a decrease in throughput suppressed. More frequently executed ejection state sensing processes allow any ejection port in the inappropriate ejection state to be immediately sensed so as to enable an inappropriate-ejection compensation process corresponding to the ejection port in the inappropriate ejection state to be carried out. This allows prevention of degradation of the image quality caused by the inappropriate ejection of droplets through the ejection port. Furthermore, when the ejection state sensing process is more frequently carried out, if the inappropriate condition of the liquid in the ejection port results in the inappropriate ejection state, the corresponding heater can be dealt with and prevented from being defective by for example, stopping driving the heater. Since the ejection port in the inappropriate ejection state can thus be immediately dealt with, the lifetime of the heater is expected to be increased, thus improving the reliability of the printing apparatus.

Now, the ejection state sensing operation performed by the ink jet printing apparatus according to the present embodiment will be described.

As described above, the ink jet print head 111 in the ink jet printing apparatus according to the present embodiment includes a set of two ejection port rows with black nozzles, a set of two ejection port rows with cyan nozzles, a set of two ejection port rows with magenta nozzles, and a set of two ejection port rows with yellow nozzles. In each set of ejection port rows, one of the two ejection port rows is staggered with respect to the other by a half pitch. For the ejection port rows with the black nozzles, 1,920 nozzles are arranged at an arrangement density of about 245 nozzles per 1 cm. For the ejection port rows with the cyan, magenta, and yellow nozzles, 3,840 nozzles are arranged at an arrangement density of about 490 nozzles per 1 cm.

The first ejection state sensing process follows each of the recovery processes carried out at the respective predetermined timings. The timings at which the recovery process is carried out are determined by a dot count, the number of print media printed, or a print status. In the present embodiment, a suction recovery process as a recovery process is carried out every time 100 print media are printed.

The first ejection state sensing process is intended to sense the ejection state of all the ejection ports in the print head 111. Thus, in the present embodiment, the first ejection state sensing process, carried out on all the ejection ports on the print head, has been found to require about 2 minutes. Thus, when the first ejection state sensing process is carried out, the ejection state sensing process is executed over a relatively long time. However, before the first ejection state sensing process is carried out, the suction process is executed. The suction recovery process originally requires at least 5 minutes, which is longer than the time required for the ejection state sensing process. Thus, carrying out the entire first ejection state sensing process during this period prevents the user from being very conscious of the wait time during the ejection state sensing process. Hence, the ejection state sensing process for all the ejection ports is daringly carried out during the period.

To reduce the period, the sensing process may be carried out only on the last ejection ports determined to be in the inappropriate ejection state as the object. Furthermore, if the same ejection port is determined to be in the inappropriate ejection state even after three consecutive recovery processes, the ejection port is likely to be in the inappropriate ejection state as a result of a failure in the print element. Thus, the ejection port may be determined to be unrecoverable and excluded from the sensing targets.

The second ejection state sensing process is divisionally carried out plural times separately from the first ejection state sensing process and in parallel with the inter-sheet-feeding operation in the inter-page process. The inter-sheet-feeding operation refers to the operation between the roll paper feeding process and the roll paper return process included in the inter-page process shown in FIG. 2. During this operation, the carriage need not operate and stands by at the home position. The present embodiment utilizes this period to carry out the ejection state sensing process at this timing.

Furthermore, the second ejection state sensing process is carried out on any one of the ejection port groups into which the ejection ports are pre-divided as evenly as possible in the ejection ports formed in the print head as target of the ejection state sensing process. When the ejection ports formed in the print head are divided into the ejection port groups, the number of ejection ports in each of the ejection port groups is such that the second ejection state sensing process can be completed on the ejection port group during the inter-sheet-feeding operation. The printing apparatus used in the present embodiment is adapted for large-sized print media; the print media used in the printing apparatus are relatively large. Thus, conveyance of each print medium during a single inter-page process has been found to require about 5 seconds. During 5 seconds, the ejection state sensing process can be carried out on about 560 ejection ports. Then, to be subjected to the ejection state sensing process, all the ejection ports in the print head may be divided into at least 24 ejection port groups.

Figure 7:
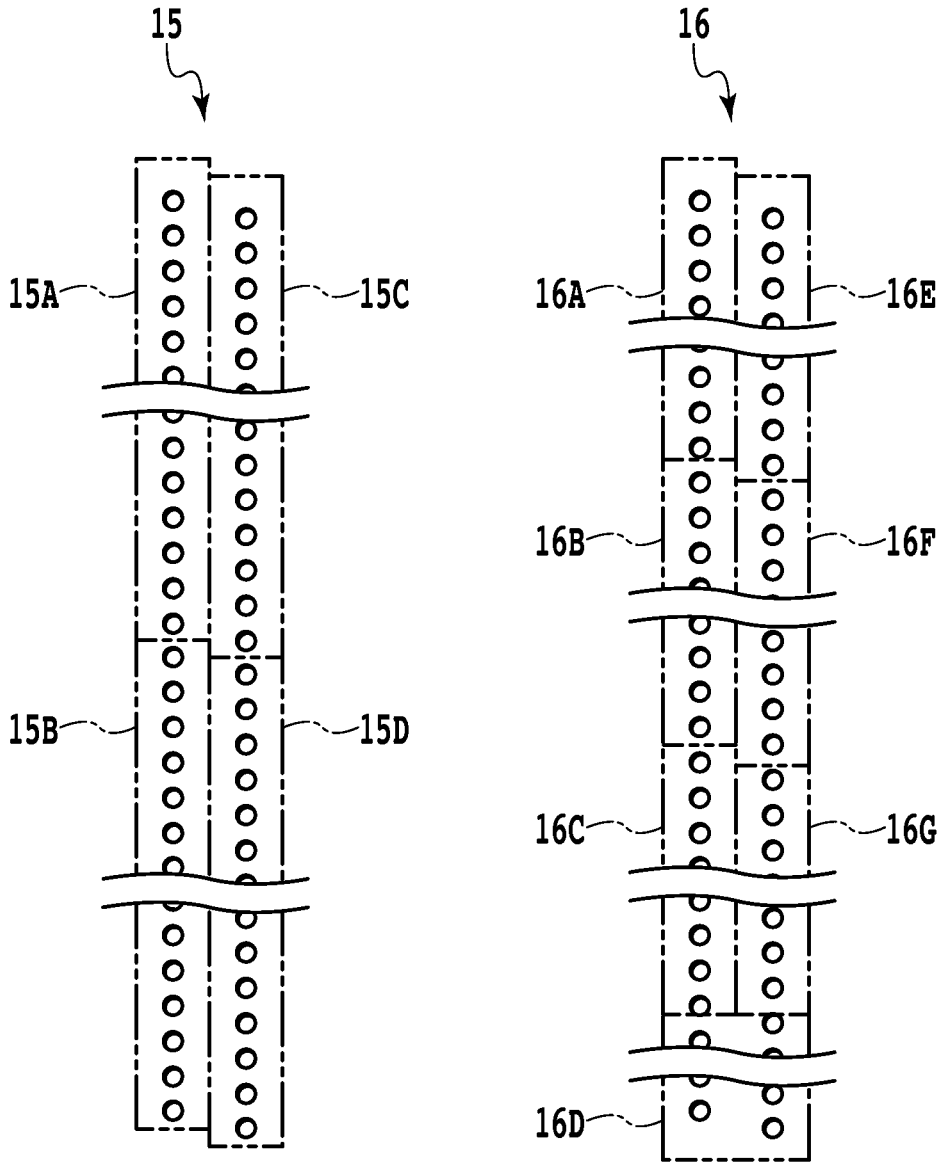
FIG. 7 is a diagram illustrating each of a plurality of ejection port groups into which the ejection ports formed in the print head are divided when the second ejection state sensing process is carried out by the printing apparatus according to the embodiment of the present invention.

The ejection ports can be divided into ejection port groups in any of various manners. In the present embodiment, all the print heads formed in the print head 111 are divided into 25 ejection port groups as shown in FIG. 7. The plurality of ejection ports are divided into a plurality of ejection port groups each of which is enclosed by a dashed line in FIG. 7. The black ejection ports 15 shown in FIG. 3 are divided into four ejection port groups 15A to 15D. The cyan ejection ports 16 are divided into seven ejection port groups 16A to 16G. Similarly, the magenta ejection ports 17 are divided into seven ejection port groups, and the yellow ejection ports 18 are divided into seven ejection port groups.

Figure 8:
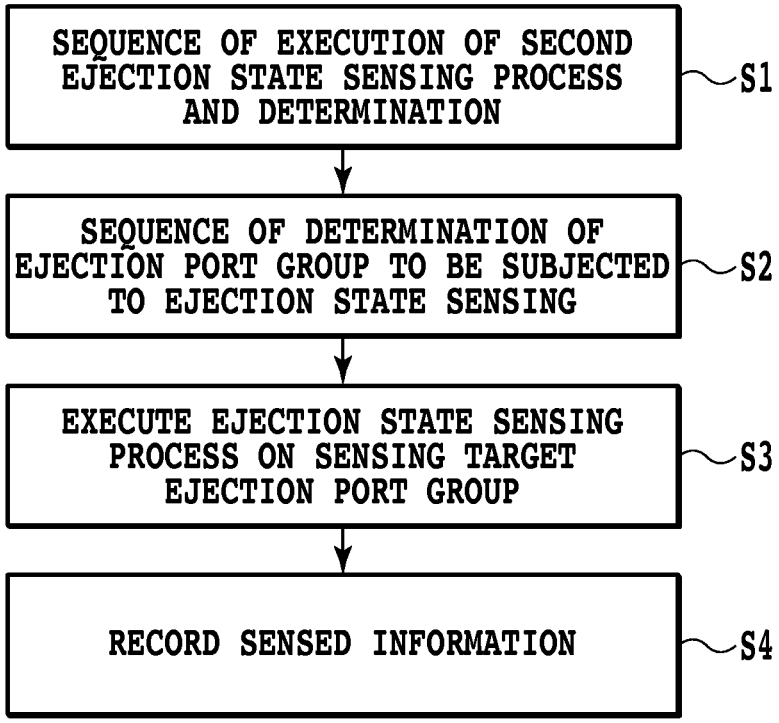
FIG. 8 is a flowchart showing a control process used when the second ejection state sensing process is carried out by the printing apparatus according to the embodiment of the present invention.

The execution sequence of the second ejection state sensing process according to the present embodiment will be described with reference to FIG. 8. First, in S1, when the inter-page process is carried out during continuous printing, the apparatus determines whether or not to carry out the second ejection state sensing process. When the second ejection state sensing process is to be carried out, then in S2, the apparatus determines an ejection port group of which the ejection state is to be sensed, based on address information on the ejection port groups resulting from the division, information on the last ejection port groups, and the like. Subsequently, in S3, the ejection state sensing unit is used to carry out the ejection state sensing process on the ejection port group determined in S2 to be subjected to ejection state sensing. Finally, in S4, the results of the ejection state sensing process are stored in an information storage medium. Based on this information, if any ejection port has been determined to be in the inappropriate ejection state, inappropriate-ejection compensation printing as an inappropriate-ejection compensation process is performed during printing.

Now, the inappropriate-ejection compensation printing will be described. The inappropriate-ejection compensation printing method for compensating for ink droplets otherwise ejected through an ejection port determined to be in the inappropriate ejection state is performed, for example, in the following three manners.

First, if any ejection port is in the inappropriate ejection state, dots otherwise ejected through the ejection port are distributed to ejection ports located at the respective adjacent ejection port in the inappropriate ejection state (adjacent compensation). In another method, if any cyan ejection port is in the inappropriate ejection state, data corresponding to the cyan ejection port in the inappropriate ejection state is compensated for using ink dots in a different color (different color compensation). According to further another method, in a divisional printing scheme in which the print head is scanned plural times for printing, an ejection port through which no droplet is ejected is compensated for by a normal ejection port. The present invention can adopt any of the inappropriate-ejection compensation printing schemes. The inappropriate-ejection compensation printing used in the present invention is not limited to that described above, but another type of inappropriate-ejection compensation printing may be used.

Figure 9A:
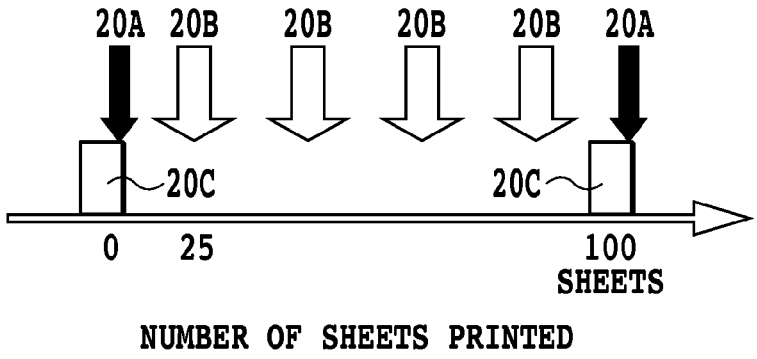
FIG. 9A is diagram illustrating timings when an ejection state sensing process is performed by the printing apparatus according to the embodiment of the present invention.

Now, with reference to FIGS. 9A to 9C, the timings when the printing apparatus according to the present embodiment carries out the ejection state sensing process will be described in comparison with a comparative example. A timing at which the ejection state sensing process is carried out by the printing apparatus according to the present embodiment is shown in FIG. 9A. In the ejection state sensing process according to the present embodiment, after a recovery process 20C, a first ejection state sensing process 20A is carried out in combination with the recovery process. In addition, between the first ejection state sensing processes 20A, a second ejection state sensing process 20B is repeatedly carried out for every plural ejection port groups. In the present embodiment, the second ejection state sensing process 20B is sequentially and repeatedly carried out between the first ejection state sensing processes 20A. Thus, the second ejection state sensing process 20B is carried out four times on all the ejection ports. In this manner, the second ejection state sensing process is sequentially and repeatedly carried out on every ejection port group resulting from the division so that all the ejection ports formed in the print head 111 are subjected to the second ejection state sensing process.

Figure 9B:
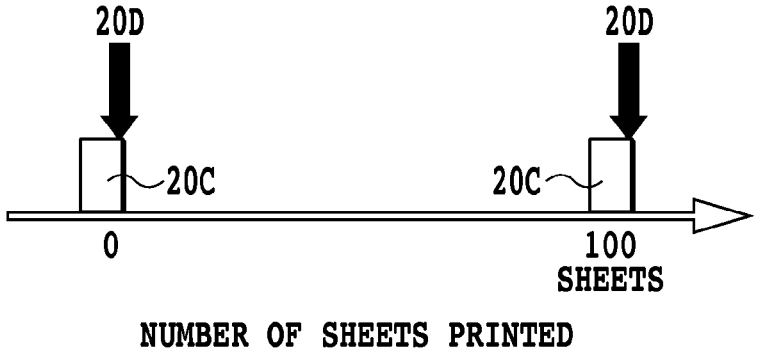
FIG. 9B is a diagram illustrating timings for the ejection state sensing process in Comparative Example 1.

FIG. 9B shows the timings when the ejection state sensing process is carried out in Comparative Example 1. In Comparative Example 1, after the recovery process 20C, an ejection state sensing process 20D for all the ejection ports is carried out. Between the timings when the ejection state sensing processes 20D for all the ejection ports are carried out, no other ejection state sensing process is carried out.

Thus, the ejection state sensing process in the printing apparatus of the present embodiment is carried out more frequently than that in Comparative Example 1 by a value corresponding to the second ejection state sensing processes. Furthermore, the second ejection state sensing process in the present embodiment is carried out during the inter-page process during the printing operation is being performed. Thus, compared to Comparative Example 1, the present embodiment allows the frequency of sensing to be increased without sharply reducing the throughput.

Figure 9C:
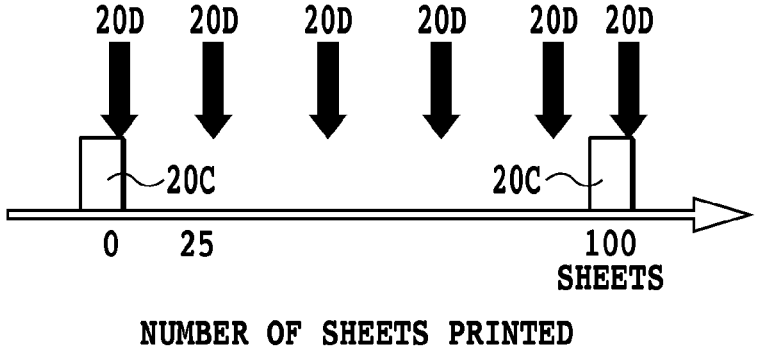
FIG. 9C is a diagram illustrating timings for the ejection state sensing process in Comparative Example 2.

Furthermore, FIG. 9C shows the timings when the ejection state sensing process is carried out in Comparative Example 2; the ejection state sensing process 20D for all the ejection ports is carried out not only after the recovery process 20C but also between the recovery processes 20C. In Comparative Example 2, between the recovery processes 20C, the ejection state sensing process 20D is carried out four times on all the ejection ports. When the ejection state sensing process is carried out, a single ejection state sensing process 20D for all the ejection ports requires about 2 minutes. Thus, the ejection state sensing process in the printing apparatus according to the present embodiment allows the wait time to be reduced by 10 minutes compared to that in Comparative Example 2. Hence, a part of the ejection state sensing process according to the present embodiment is carried out in parallel with the inter-page process executed between the printing operations. Therefore, compared to Comparative Example 2, the present embodiment enables a reduction in the wait time resulting from the ejection state sensing process.

Furthermore, according to the ejection state sensing process in the printing apparatus of the present embodiment, even with an increase in the number of ejection ports in the print head, a corresponding decrease in printing throughput can be suppressed. Normally, an increase in the number of ejection ports in the print head correspondingly increases the number of targets for the ejection state sensing process and thus the time for which the printing operation remains suspended. Thus, the printing requires a longer time. However, according to the ejection state sensing process in the present embodiment, the second ejection state sensing process is carried out during the inter-page process. This serves to suppress a decrease in throughput while preventing the substantial printing time from being relatively long.

Figure 10:
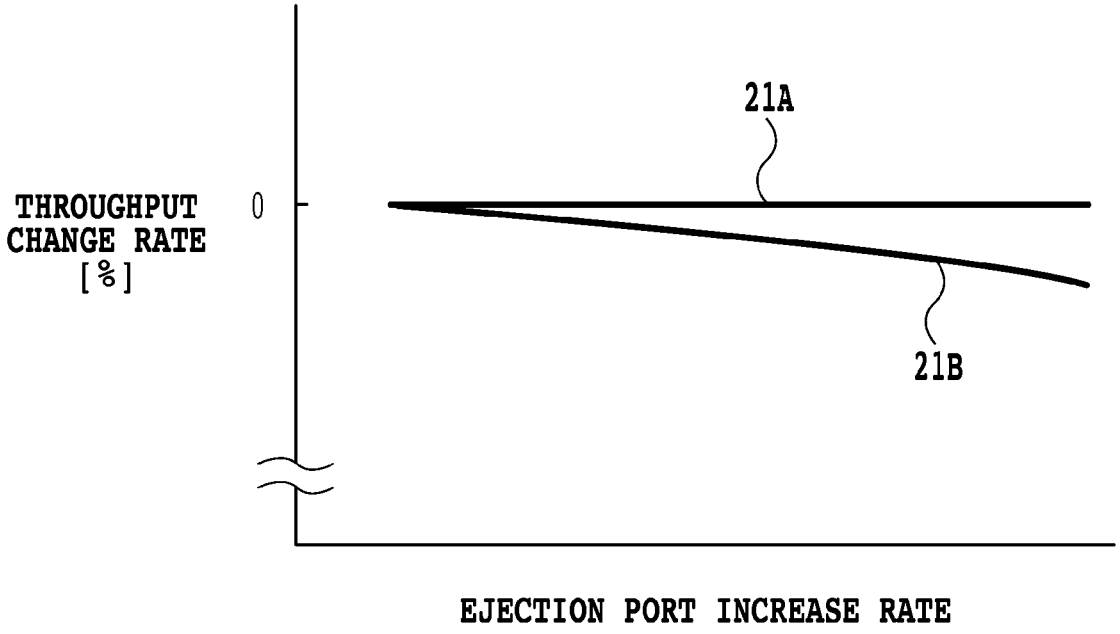
FIG. 10 is a graph showing the change rate of throughput associated with an increase in the number of ejection ports in the print head between a case of the ejection state sensing process carried out by the printing apparatus according to the embodiment of the present invention and the case of the ejection state sensing process in Comparative Example 2.

FIG. 10 is a graph showing the change rate of the throughput, which varies with an increase in the number of ejection ports in association with the ejection state sensing, for the printing apparatus according to the present embodiment and the printing apparatus in Comparative Example 2; the change rate was measured in order to verify the effects of the ejection state sensing process in the printing apparatus according to the present embodiment. Here, the change rate of the throughput refers to the ratio of the throughput after an increase in the number of ejection ports to the throughput before the increase.

As shown in the graph in FIG. 10, the change rate 21A of the throughput of the printing apparatus according to the present embodiment is such that a decrease in throughout is relatively small even with an increase in the number of ejection ports. On the other hand, the change rate 21B of the throughput of the printing apparatus in Comparative Example 2 is such that the throughput decreases relatively sharply as a result of an increase in the number of ejection ports. That is, the graph indicates that the ejection state sensing process according to the present embodiment contributes to eliminating the trade-off in printing apparatuses each with a large number of ejection ports like printers for large-sized print media.

Figure 11:
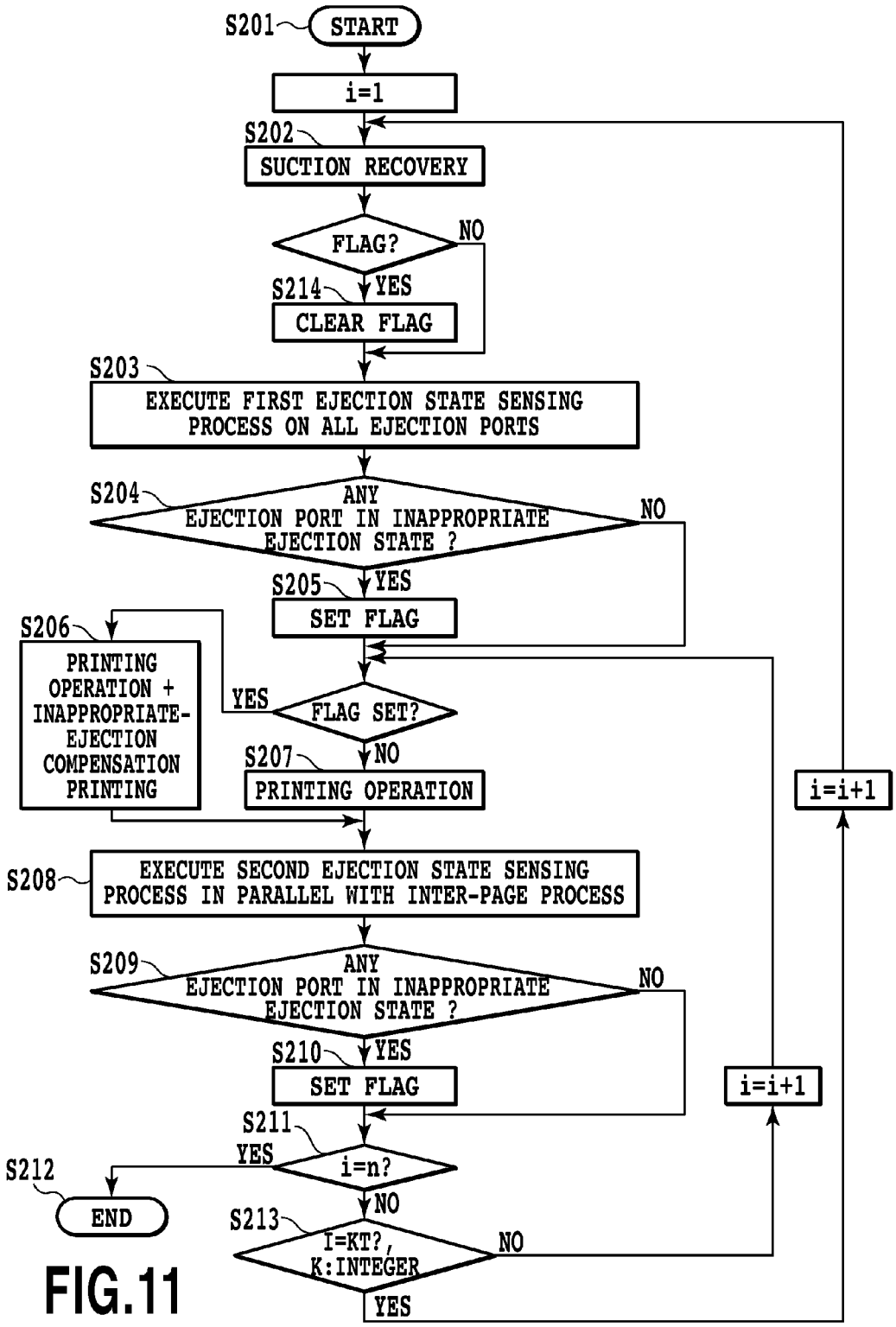
FIG. 11 is a flowchart showing a control process used when the ejection state sensing process is carried out by the printing apparatus according to the embodiment of the present invention.

Now, with reference to FIG. 11, a flowchart of a printing method for the printing apparatus according to the present embodiment will be described. FIG. 11 shows the flowchart of the printing method according to the present embodiment. In the flow in FIG. 11, printing is finished when (n) print media have been printed. The first ejection state sensing process for all the ejection ports is carried out every time (t) pages are printed, with the second ejection state sensing process carried out (t) times.

The printing method according to the present embodiment is started (S201). Then, before printing of the first page, the suction recovery (S202) is performed, and the first ejection state sensing process (S203) is carried out to sense all the ejection ports for the inappropriate ejection state. Based on the results of the sensing, the apparatus determines whether or not any ejection port is in the inappropriate ejection state (S204). If any ejection port is in the inappropriate ejection state, a flag is set (S205). Otherwise the apparatus shifts to the printing operation.

Then, during the first printing, the normal printing operation is performed on one print medium. At this time, if any ejection port is determined by the first ejection state sensing process to be in the inappropriate ejection state, then in addition to the normal printing operation, the inappropriate-ejection compensation printing is performed on the print medium for printing (S206). Furthermore, if no ejection port is in the inappropriate ejection state, the normal printing operation is performed (S207). Once the printing operation is finished on one print medium, the second ejection state sensing process is carried out in parallel with the inter-page process (S208). In the present embodiment, every time the operation of printing one page is finished, the second ejection state sensing process 7B is carried out in parallel with the inter-page process. At this time, the inter-page process is the steps between the roll paper feeding and roll paper return in FIG. 2.

Then, based on the results of the second ejection state sensing process, the apparatus determines whether or not any ejection port is in the inappropriate ejection state (S209). In the second ejection state sensing process, if any ejection port is determined to be in the inappropriate ejection state, a flag is set (S210). In the second ejection state sensing process, if no ejection port is determined to be in the inappropriate ejection state, no new flag is set, and the flow proceeds to the subsequent steps. Then, in S211, the apparatus determines whether or not all the pages have been printed. If all the pages ((n) pages) have been printed, the printing is ended in S212.

If not all the pages have been printed, then in S213, the apparatus determines whether or not a printing operation for every (t) pages has not just been finished. If a printing operation for every (t) pages has not just been finished, the flow is returned to a stage immediately after S205. Thereafter, the normal printing operation or a printing operation performed in parallel with the inappropriate-ejection state compensation printing operation is performed.

If a printing operation for every (t) pages has just been finished, the flow is returned to the stage preceding S202. Then, in S202, the suction recovery is performed. At this time, since the suction recovery is performed in S202, even if a flag has already been set, the flag is temporarily cleared (S214). Thereafter, in S203, the first ejection state sensing process is carried out on all the ejection ports. The subsequent part of the flow is repeated.

Figure 12:
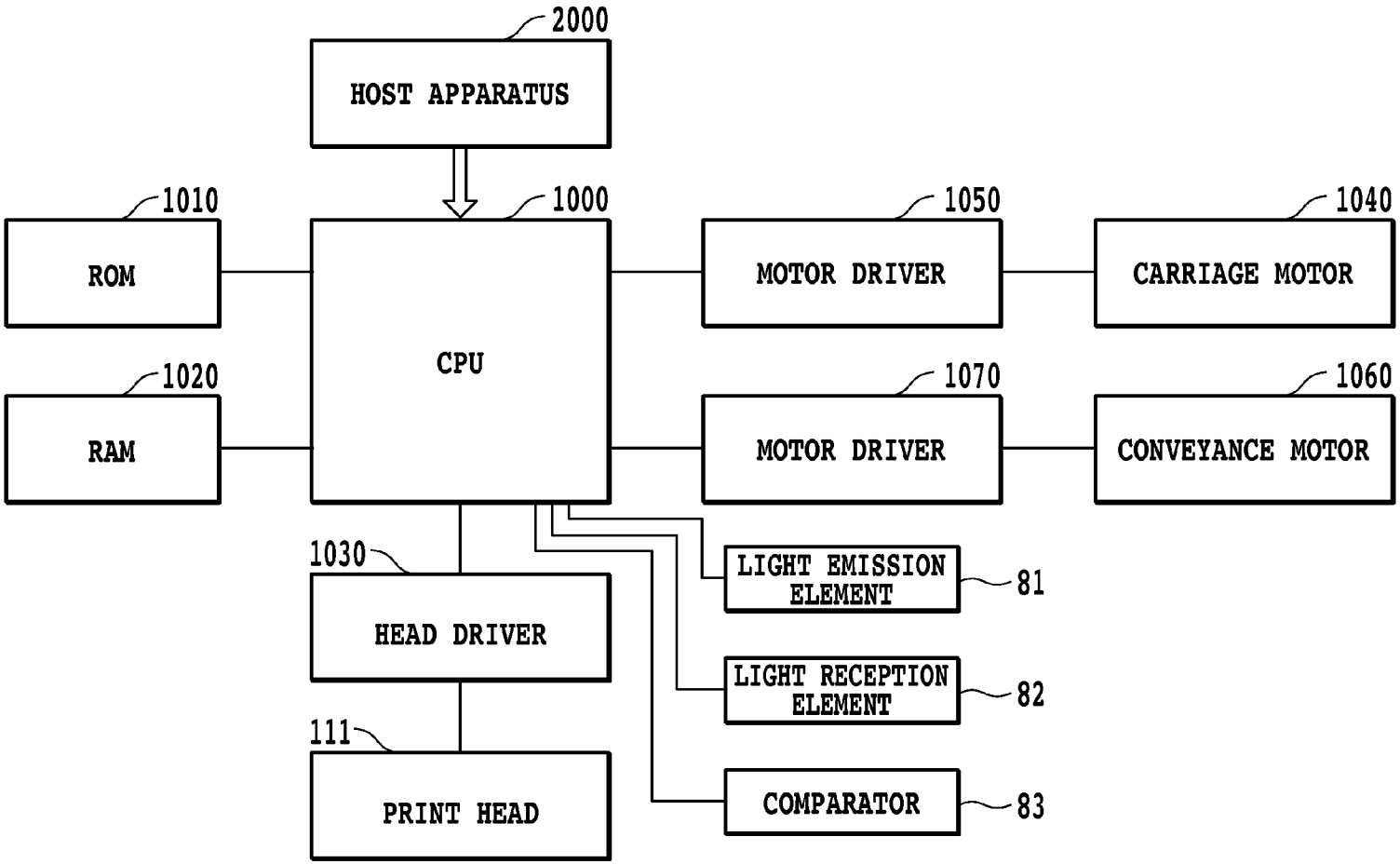
FIG. 12 is a block diagram of a control system for the printing apparatus in FIG. 1.

FIG. 12 is a block diagram of the configuration of a control system for the ink jet printing apparatus according to the present embodiment. A CPU 1000 executes, for example, control processing and data processing for various operations in response to inputs from a host apparatus 2000. A ROM 1010 is configured to store programs for the procedures of the processing and the like. Furthermore, a RAM 1020 is used as a work area or the like in which the processing is executed. Ink is ejected from the print head 111 by supplying driving data (image data) and driving control signals (heat pulse signals) of the electrothermal conversion members and the like to a head driver 1030 by the CPU 1000. The CPU 1000 controls a carriage motor 1040 via a motor driver 1050 in order to drive the carriage in the main scan direction and controls a conveyance motor 1060 via a motor driver 1070 in order to convey print media.

Furthermore, the CPU 1000 allows the light emission element 81 to emit light during the ejection state sensing process for the ejection ports. For the first ejection state sensing process carried out on all the ejection ports in the print head, the light emission element 81 is allowed to emit light at a position corresponding to each of the ejection ports to carry out the ejection state sensing process on all the ejection ports. If the ejection state sensing process is carried out only on a part of the ejection port groups into which the plurality of ejection ports in the print head have been divided, the light emission element 81 is allowed to emit light at a position corresponding only to these ejection port groups. Then, the CPU 1000 senses the quantity of light having reached to the light reception element 82 via the area through which ink droplet pass. The quantity of light received by the light reception element at this time is compared with that received by the light reception element when ink is ejected normally. For the comparison, the quantity of light received during normal ejection is read which quantity is pre-stored in a storage area such as the ROM 1010 or the RAM 1020. Then, the light reception quantity detected during the ejection state sensing process is compared with the light reception quantity obtained during the normal ejection. The comparison is carried out by the comparator 83 by comparing a voltage value obtained by the light reception element and corresponding to the light reception quantity, with a voltage value Vref obtained by the light reception element during reference ink ejection.

When any ejection port is determined to be in the inappropriate ejection state, the CPU 1000 allows the head driver 1030 to drive the print head so that the print head performs not only the normal printing operation but also the inappropriate-ejection compensation printing. Thus, in the present embodiment, the CPU 1000 functions as first ejection state sensing means for carrying out the first ejection state sensing process of sensing the ink droplet ejection state of all the ejection ports in the print head at a single ejection state sensing process. Furthermore, the CPU 1000 functions as second ejection state sensing means for carrying out the ejection state sensing process as the second ejection state sensing process on the ejection ports in a part of the plurality of ejection port groups into which the plurality of ejection ports formed in the print head have been divided.

In the present specification, "printing" refers to formation of information regardless whether the information is meaningful as in the case of characteristics and figures or is meaningless. Furthermore, "printing" broadly expresses formation of an image or a pattern or processing of a print medium regardless of whether or not the image or pattern or the print medium is actualized so as to be visually perceivable Furthermore, the "print medium" not only refers to paper, used in common printing apparatuses, but also refers broadly to a substance such as a cloth, a plastic film, a metal plate, glass, ceramics, woods, or leather which can receive ink.

Moreover, the "ink" or the "liquid" needs to be broadly interpreted and refers to a liquid applied onto a print medium to form an image, a pattern, or the like, process the print medium, or treat the ink or the print medium. Here, the treatment of the ink or the print medium refers to, for example, improvement of fixability of the ink resulting from solidification or insolubilization of a color material in the ink, improvement of print quality or coloring capability, or improvement of image durability.

Additionally, the above-described printing apparatus is what is called a serial scan type printing apparatus configured to print an image by moving the print head in the main scanning direction while conveying the print medium in the sub-scanning direction. However, the present invention is applicable to a full line type printing apparatus that uses a print head extending all along the width of the print medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-198054, filed Aug. 28, 2009, which is hereby incorporated by reference herein in its entirety.

What is claimed is:

1. A printing apparatus in which a print head including a plurality of ejection ports formed therein is capable of being mounted, a liquid being ejected through the ejection ports, the printing apparatus comprising:

first ejection state sensing means for carrying out an ejection state sensing process of determining whether or not ejected droplets are normal, during a single process, on all the ejection ports formed in the print head; and second ejection state sensing means for carrying out the ejection state sensing process on the ejection ports in a part of a plurality of ejection port groups into which the plurality of ejection ports formed in the print head are divided, wherein the second ejection state sensing means carries out the ejection state sensing process between end of printing of one print medium and start of printing of a next print medium.

2. The printing apparatus according to claim 1, wherein the second ejection state sensing means carries out the ejection state sensing process sequentially and repeatedly for each of the plural ejection port groups between the ejection state sensing processes carried out by the first ejection state sensing means so as to effect execution on all the ejection ports formed in the print head.

3. The printing apparatus according to claim 1, wherein when any ejection port is determined by the first or second ejection state sensing means to be in an inappropriate ejection state, an inappropriate-ejection compensation process is carried out in which another ejection port is used for printing corresponding to the ejection port in the inappropriate ejection state.

4. The printing apparatus according to claim 1, wherein the print head is capable of being subjected to a recovery process of recovering an ejection state of the plurality of ejection ports, and the first ejection state sensing means carries out the ejection state sensing process after the recovery process.

5. A printing method of performing printing using a printing apparatus in which a print head including a plurality of ejection ports formed therein is capable of being mounted, a liquid being ejected through the ejection ports, the printing method comprising:

a first ejection state sensing process step of carrying out an ejection state sensing process of determining whether or not ejected droplets are normal, during a single process, on all the ejection ports formed in the print head; and a second ejection state sensing process step of carrying out the ejection state sensing process on the ejection ports in a part of a plurality of ejection port groups into which the plurality of ejection ports formed in the print head are divided, the second ejection state sensing process step being carried out between end of printing of one print medium and start of printing of a next print medium.

* * * * *